US008333296B1

(12) United States Patent
Fung

(10) Patent No.: US 8,333,296 B1
(45) Date of Patent: Dec. 18, 2012

(54) THERMALLY INSULATED FOLDABLE CUP FOR HOT OR COLD BEVERAGES

(76) Inventor: Duncan C. Fung, Richmond, VA (US)

( * ) Notice: Subject to any disclaimer, the term of this patent is extended or adjusted under 35 U.S.C. 154(b) by 129 days.

(21) Appl. No.: 13/065,751

(22) Filed: Mar. 29, 2011

Related U.S. Application Data

(63) Continuation-in-part of application No. 12/798,654, filed on Apr. 8, 2010, now abandoned.

(51) Int. Cl.
*B65D 81/38* (2006.01)

(52) U.S. Cl. ..... 220/592.17; 220/666; 229/405

(58) Field of Classification Search ..... 220/592.16, 220/592.17, 666, 703, 737, 739, 916; 229/403, 229/405
See application file for complete search history.

(56) References Cited

U.S. PATENT DOCUMENTS 2,402,944 A * 7/1946 Braloff ..... 229/117.01
4,428,500 A * 1/1984 Kohler ..... 229/117
4,978,021 A 12/1990 Mini et al.
5,310,068 A 5/1994 Saghri
6,047,848 A 4/2000 Davis
6,082,896 A 7/2000 Pulli
7,225,841 B2 6/2007 Folk

* cited by examiner

*Primary Examiner* — Harry Grosso

(57) ABSTRACT

A thermally insulated foldable cup for hot or cold beverages including a flexible inner liner, an outer shell, and an insulating layer between the outer shell and inner liner. The foldable cup includes reinforcing rings at the bottom and top of the cup and two vertical reinforcing strips on opposing sides of the cup. The foldable cup can be folded from an expanded configuration, in which liquids can be poured into and held in the cup, to a folded configuration in which two sides of the cup can be folded about a vertical plane through the cup in order to reduce the size of the cup while it is not in use. The foldable cup further includes a base member and a cap member connected by a anchor strip. A locking strap extending from the base member can be used to maintain the folded cup in the folded configuration.

12 Claims, 6 Drawing Sheets

THERMALLY INSULATED FOLDABLE CUP FOR HOT OR COLD BEVERAGES

This application is a Continuation-In-Part of U.S. patent application Ser. No. 12/798,654, filed on Apr. 8, 2010 now abandoned and entitled "Thermally Insulated Collapsible Cup for Hot or Cold Beverages", of which the entire contents of said application is incorporated herein in its entirety by reference thereto.

FIELD OF THE INVENTION

The present invention relates to containers and particularly to an insulated drinking container for hot or cold drinks that includes an outer shell, a flexible inner liner, and an insulating layer between the outer shell and inner liner that enables the container to be folded or collapsed to a smaller profile when not in use to enable more efficient storage.

BACKGROUND OF THE INVENTION

Hot beverages, such as coffee or tea, are consumed by people on a daily basis. Many people frequently visit convenience stores or specialty coffee shops in order to obtain their favorite hot beverage. Disposable cups are typically provided by these retailers for the use of their patrons for conveniently holding the liquids. The disposable cups are typically poorly insulated and, when disposed of, add significantly to the solid waste stream that must be disposed in landfills.

Many consumers provide their own reusable containers for hot or cold beverages. After the beverages are consumed, many hot drink containers are either left in the car or carried into the workplace or the home where they are then stored and reused in those locations. Over a period of time, a large number of hot drink containers tend to accumulate in the car, the home, or the office.

One problem that arises with reusable containers is the resulting accumulation of a large number of containers which typically requires a large amount of space during storage. Many typical insulated cups or containers are of quite a large size and require a significant amount of shelf space during storage. The typical homeowner frequently finds that they do not have enough space for storing the many insulated drink containers that they have accumulated. Although collapsible containers have been proposed in the prior art, many are for dry food storage items such as powders and others do not include the ability to thermally insulate the materials held within.

Thus, what is needed is an insulated cup that can be reduced in size for storage in order to consume less shelf space during storage. The insulated cup should also be of low cost and reusable, which would make it an acceptable substitute for disposable cups and thereby reduce the amount of solid waste that must be disposed in landfills. What is also needed is a drink container that will securely hold a liquid therein, that is thermally insulated to keep hot beverages hot and cold beverages cold while in use, and that can be reduced significantly in size in order to conserve shelf space when not in use.

SUMMARY OF THE INVENTION

According to the present invention, there is provided a thermally insulated foldable cup for hot or cold beverages. The thermally insulated foldable cup includes a flexible inner liner, an outer shell, and an insulating layer between the outer shell and inner liner. The foldable cup includes reinforcing rings at the bottom and top rims of the cup and two vertical reinforcing strips on opposing sides of the cup. The foldable cup can be folded from an expanded configuration, in which liquids can be poured into and held in the cup, to a folded configuration in which two sides of the cup can be folded about a vertical plane through the cup in order to collapse the cup to save space while it is not in use. To maintain the foldable cup in the expanded configuration, a base member is provided for insertion at the bottom of the cup. The foldable cup further includes a cap member which is connected to the base member by an anchor strip. A locking strap extends from the base member and can be connected to the cap member in order to hold the folded cup in the folded configuration. The flexible liner is a liquid-tight inner liner that holds liquids inside the cup in the expanded configuration. An insulation layer is provided between the outer shell and the inner liner. The insulation layer maintains the temperature of hot liquids or cold liquids within the foldable cup and minimizes heat transfer to the outer shell thereby protecting the hands of a user while using the cup.

OBJECTS AND ADVANTAGES

Several advantages are achieved with the thermally insulated foldable cup of the present invention, including:

(1) The foldable cup of the present invention is thermally insulated, thereby maintaining hot liquids or cold liquids at the desired temperature.

(2) The foldable cup of the present invention has provided unexpected results in that it provides a cup that can be folded into a significantly smaller size for storage thereby greatly reducing the amount of required storage space.

(3) The foldable cup provides a low cost alternative to disposable cups.

(4) By reducing the need for a disposable cup, the foldable cup can reduce the amount of solid waste that must be disposed of in landfills.

(5) For hot drinks, the foldable cup eliminates the need for a separate sleeve in order to protect a user's hands from heat transmitted to the outer surface of the cup.

(6) The foldable cup of the present invention maintains its shape when expanded to its unfolded state.

(7) Use of a one-piece flexible liner has provided the unexpected result that the foldable cup of the present invention is capable of supporting liquids in both the collapsed and expanded configurations.

(8) Use of a flexible silicone rubber liner provides a liquid tight seal with the cap at the top of the cup.

These and other objects and advantages of the present invention will be better understood by reading the following description along with reference to the drawings.

TABLE OF NOMENCLATURE

Figure 1:
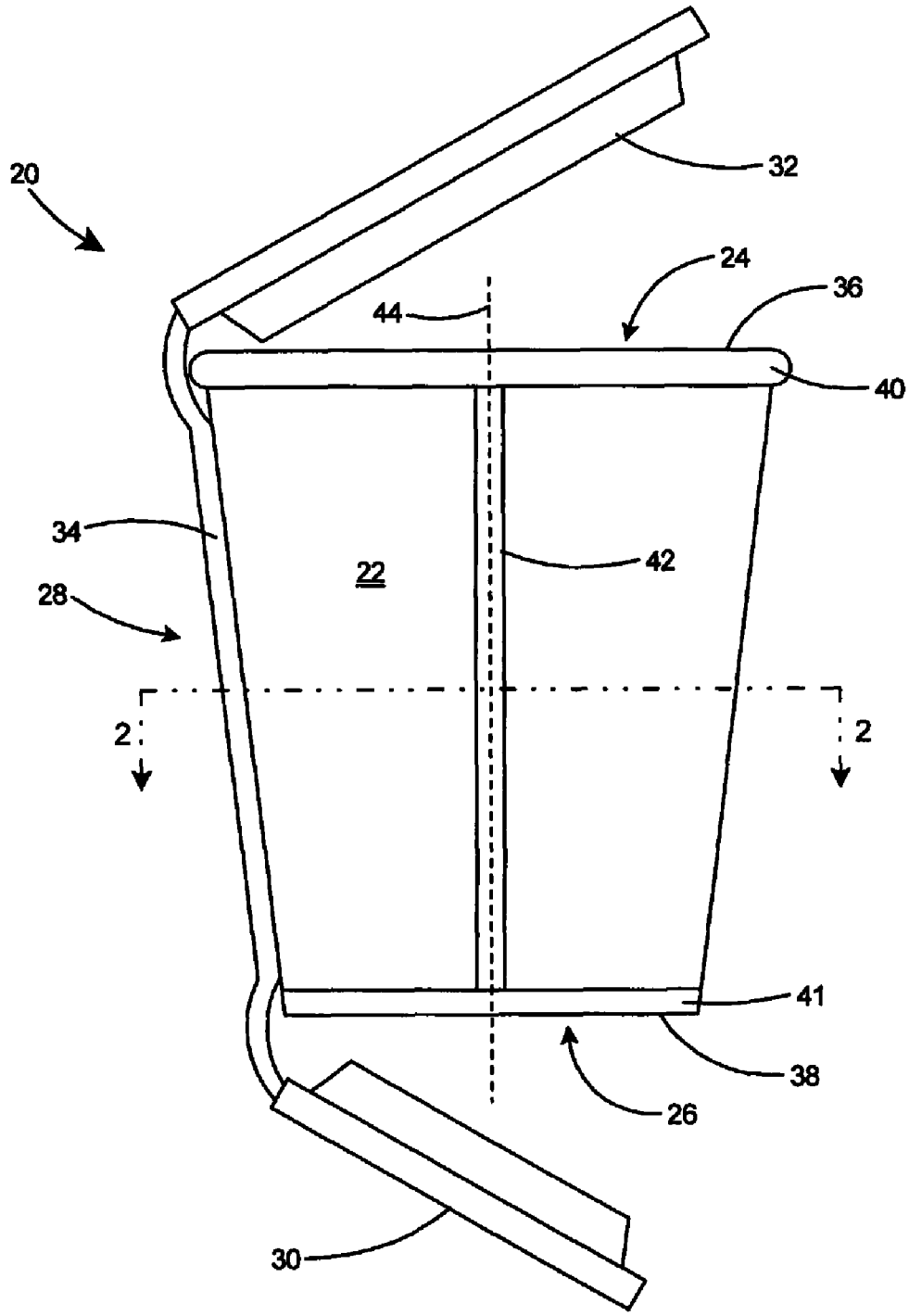
FIG. 1 is a side view of a preferred embodiment of the thermally insulated foldable cup of the present invention in its expanded configuration.

The following is a listing of part numbers used in the drawings along with a brief description:

| Part Number | Description |
|---|---|
| 20 | foldable cup |
| 22 | cup wall |
| 24 | top opening |
| 26 | bottom opening |
| 28 | closing arrangement |
| 30 | base member or base |
| 32 | cap member or cap |
| 34 | anchor strip |
| 36 | top rim |
| 38 | bottom rim |
| 40 | top reinforcing ring |
| 41 | base reinforcing ring |
| 42 | reinforcing strip |
| 44 | hinge lines |
| 46 | outer shell |
| 48 | inner liner |
| 50 | insulating layer |
| 51 | corrugated paper |
| 52 | aperture in anchor strip |
| 54 | adhesive |
| 56 | flange |
| 58 | bottom sealing portion |
| 60 | lid portion |
| 62 | top sealing portion |
| 64 | spout |
| 66 | locking strap |
| 68 | first end of locking strap |
| 70 | second end of locking strap |
| 72 | cap engagement mechanism |
| 74 | plane |
| 76 | force arrow |
| 77 | directional arrow |
| 78 | force arrow |
| 80 | post |
| 82 | outer surface of outer shell |
| 84 | stem of post |
| 86 | rim of post |
| 88 | outer surface of inner liner |
| 90 | inner surface of outer shell |

DETAILED DESCRIPTION

With reference to a first and preferred embodiment in FIG. 1, the present invention is a thermally insulated foldable cup 20. The foldable cup 20, depicted in its expanded configuration in FIG. 1, is capable of being reconfigured between an expanded configuration and a folded configuration as will be described herein with reference to a preferred embodiment. The foldable cup 20 includes a cup wall 22 of substantially cylindrical shape and having a top opening 24 and a bottom opening 26. The foldable cup 20 includes a closing arrangement 28 for keeping the cup in an expanded configuration or in a folded configuration as selected by the user. The closing arrangement 28 includes a base member or base 30, a cap member or cap 32, and an anchor strip 34 connecting the base member 30 to the cap member 32. The anchor strip 34 is secured to the cup wall 22. The foldable cup 20 further includes a top rim 36 and a bottom rim 38. A top reinforcing ring 40 is provided at the top rim 36 and a base reinforcing ring 41 is provided at the bottom rim 38 of the cup 20. Two reinforcing strips 42 are provided on opposing sides of the cup 20. The reinforcing strips 42 define hinge lines 44 around which two sides of the cup 20 can be folded about a plane through the hinge lines 44 to place the cup in a folded configuration.

Figure 2:
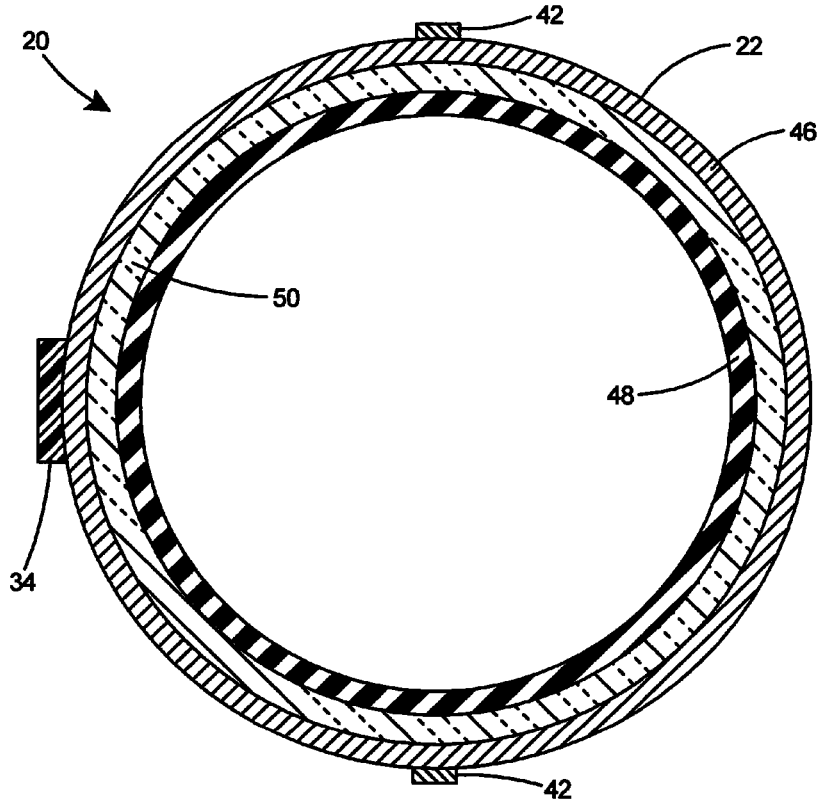
FIG. 2 is a sectional view of the foldable cup taken along line 2-2 of FIG. 1.

With reference to the sectional view of the foldable cup 20 in FIG. 2, the cup wall 22 includes an outer shell 46, a flexible inner liner 48, and an insulating layer 50 between the outer shell 46 and the inner liner 48. The outer shell 46 is substantially rigid but flexible and is preferably constructed of metal, plastic, paper, or paper laminated with plastic. As shown in FIG. 2, the reinforcing strips 42 are on opposing sides of the foldable cup 20 and the anchor strip 34 is secured to the outer shell 46. 18. The anchor strip 34 is preferably secured to the outer shell 46 of the foldable cup with adhesive or with snaps.

Figure 3:
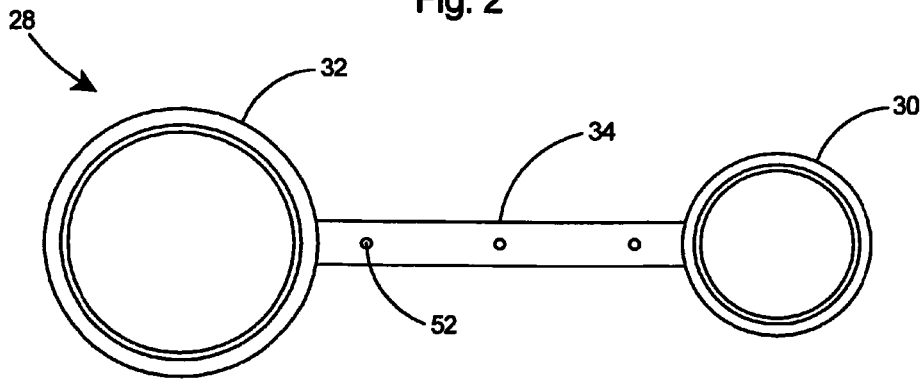
FIG. 3 is a plan view of a base member, cap member, and anchor strip that forms a portion of the foldable cup of FIG. 1.

Referring to FIG. 3, there is shown the closing arrangement 28 includes the base member 30 and the cap member 32 connected by the anchor strip 34. The closing arrangement 28 including the base member 30, cap member 32, and anchor strip 34 is preferably molded in one piece of plastic. The anchor strip 34 may include apertures 52 therein for snapping onto circular posts (see FIG. 9) extending from the outer shell 46 of the foldable cup 20.

Figure 4:
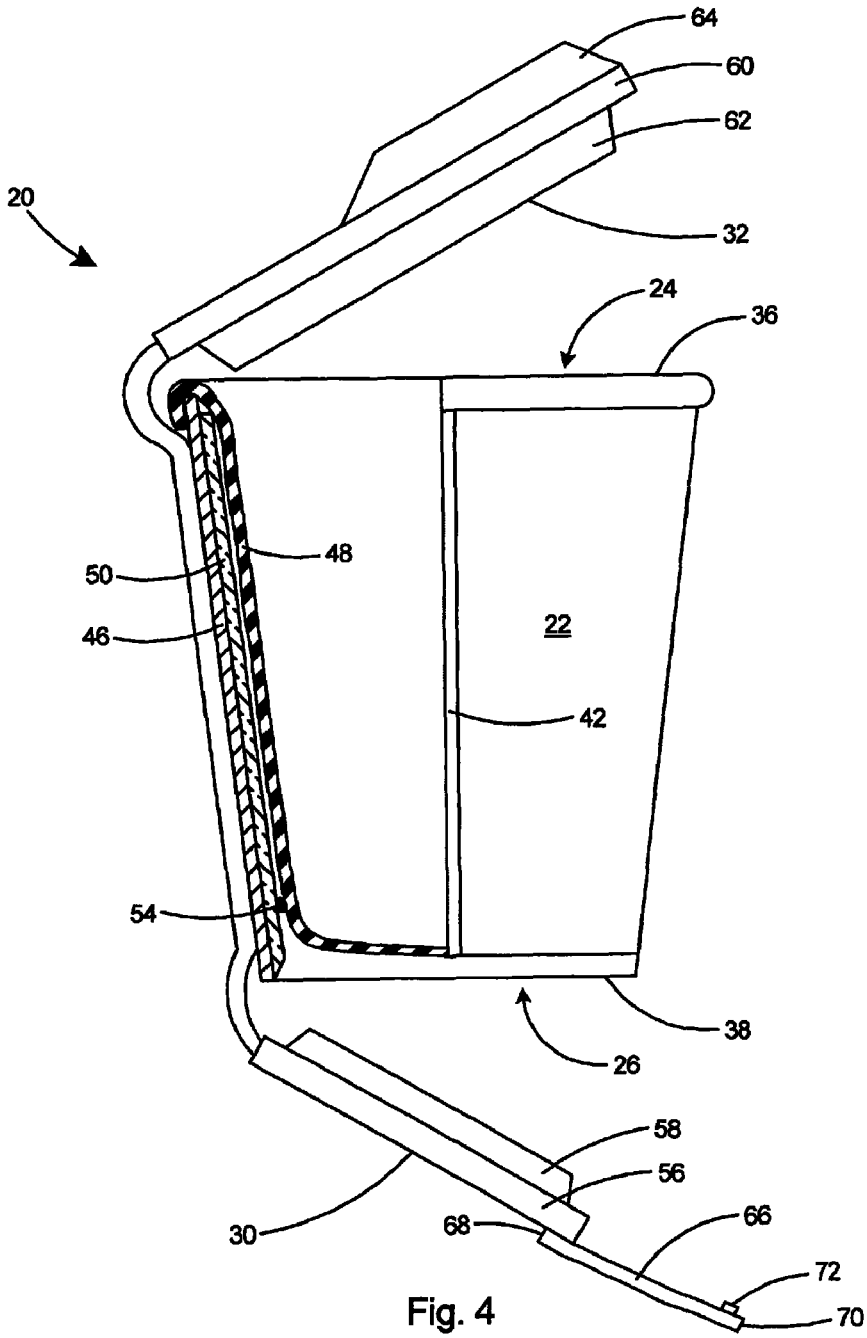
FIG. 4 is a side view similar to FIG. 1 but with a portion of the cup cut away to show the various layers of construction of the foldable cup.

With reference to the cutaway view of the foldable cup in the expanded configuration in FIG. 4, the preferred embodiment of the foldable cup 20 is an assembly including the flexible inner liner 48 laid within the substantially cylindrical outer shell 46 and insulating layer 50. The rigid but flexible outer shell 46 in the expanded configuration supports the insulating layer 50 and the inner liner 48. Flexible inner liner 48 is preferably formed of a food grade silicone rubber and is capable of holding hot or cold liquids, such as coffee, tea, or soft drinks, without leakage. Preferably, the flexible inner liner 48 is secured to the insulating layer with adhesive 54 in one or more locations near the bottom rim 38 of the foldable cup 20 to maintain the flexible liner 48 within the cup when turned over. As shown in the cutaway portion of FIG. 4, flexible inner liner 48 is preferably wrapped around the cup wall 22 at the top rim 36 of the foldable cup 20. For added support at the top a top reinforcing ring 40 may be included at the top rim 36 (see FIG. 1).

In order to maintain the foldable cup 20 in the expanded configuration as shown in FIG. 4, the base member 30 is inserted into the bottom opening 26 of the cup 20. The base member 30 includes a flange 56 for engaging the bottom rim 38 of the cup 20 and a bottom sealing portion 58 configured to extend within the bottom opening 26 of the foldable cup 20. The cap member 32 includes a lid portion 60 for engaging and seating on the top rim 36 of the foldable cup 20 when the foldable cup is in the expanded configuration and a top sealing portion 62 extending from the lid portion 60. The top sealing portion 62 is configured to extend within the top opening 24 of the foldable cup 20 and provide a seal against the inner liner 48 at the top of the cup. The cap member 32 may include a spout 64 as shown for the user to drink through while the cap member 32 is closed on the cup. The foldable cup 20 may further include a locking strap 66 secured at a first end 68 to the base member 30 and including a free second end 70. The second end 70 of the locking strap 66 may include a cap engagement mechanism 72 as shown.

Figure 5:
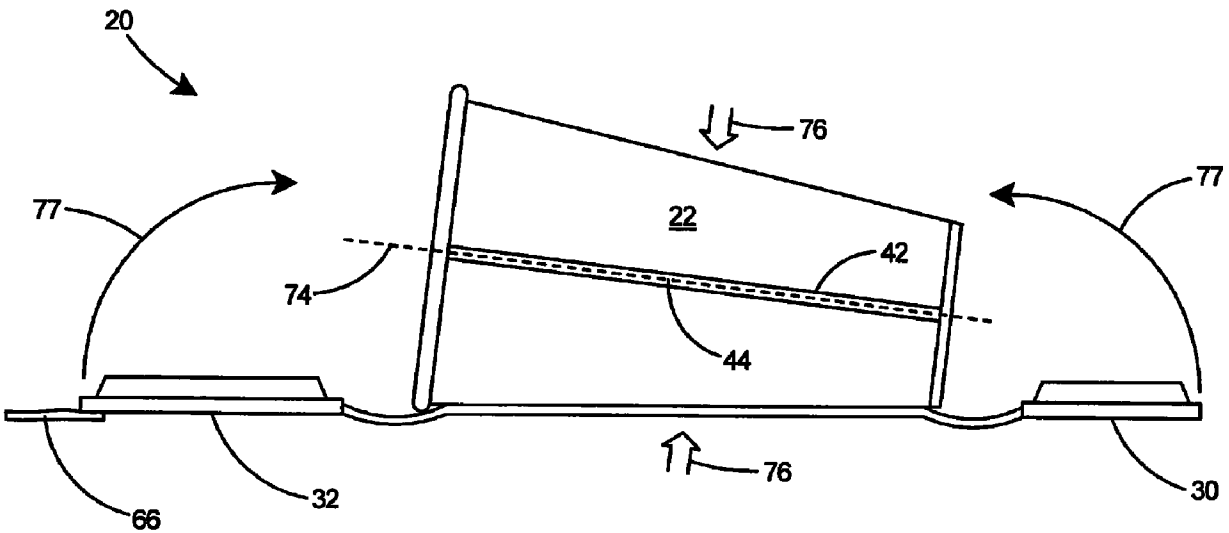
FIG. 5 is a side view of the foldable cup resting on its side and in position to be folded to its folded configuration.
Figure 6:
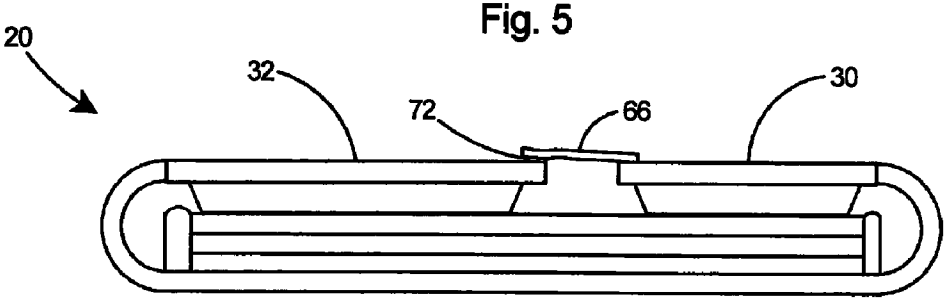
FIG. 6 is a side view of the foldable cup in its folded configuration and with the locking strap connected between the base and the cap.
Figure 7:
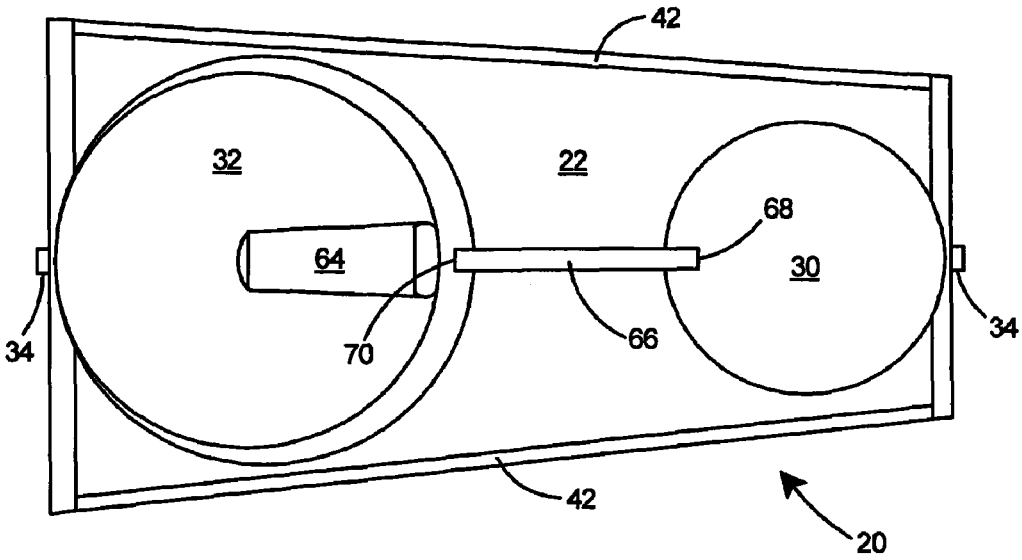
FIG. 7 is a top view of the foldable cup in the folded configuration.

Reference is made to FIGS. 5 and 6 for an understanding of the operation of the foldable cup 20 of the present invention. FIG. 5 depicts the foldable cup 20 with the cup wall 22 in the expanded configuration and with the base member 30 and cap member 32 removed from the bottom opening 26 and top opening 24 respectively. Foldable cup 20 may be folded about a plane 74 that extends through the reinforcing strips 42 defining the hinge lines 44 on opposing sides of the cup. With the cap member 32 and base member 30 removed from the openings, the user simply presses inward on opposing sides of the cup in the direction indicated by force arrows 76. By forcing the two sides of the cup together and rotating cap member 32 and base member 30 in the direction of directional arrows 77 the foldable cup 20 is converted to the folded configuration as shown in FIG. 6. The foldable cup 20 can be maintained in the folded configuration by securing the locking strap 66 to the cap member 32 with the cap engagement mechanism 72. Cap engagement mechanism 72 may be include snaps or hook and loop fasteners. Hook and loop fasteners are known by trade name VELCRO® brand fasteners and are available from commercial vendors such as Industrial Webbing Corporation in Boynton Beach, Fla. As shown in FIG. 6, the final profile of the folded cup is substantially reduced as compared to the expanded cup of FIG. 5 and significantly reduces the amount of storage space required to store the cup. As shown in FIG. 7, the foldable cup 20 can be held in the folded configuration by attaching the second end 70 of the locking strap 66 to the cap member 32.

Figure 8A:
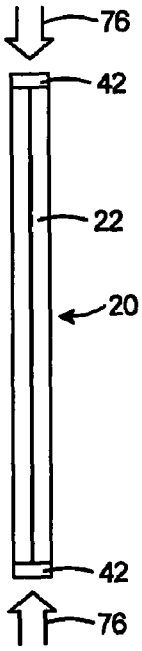
FIG. 8*a* is a conceptual top view of the foldable cup in the folded configuration.
Figure 8B:
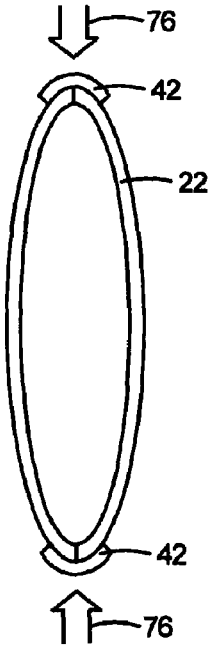
FIG. 8*b* is a conceptual top view of the foldable cup as pressure is applied to the sides of the cup.
Figure 8C:
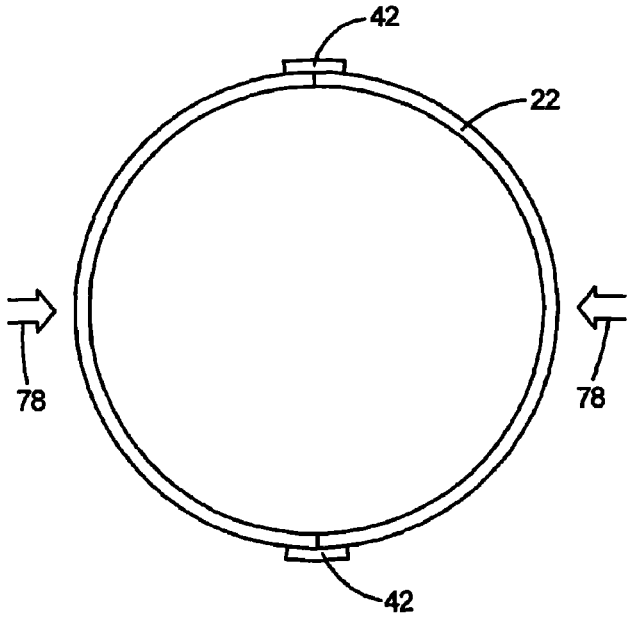
FIG. 8*c* is a conceptual top view of the foldable in the expanded configuration.

With reference to the conceptual views in FIGS. 8*a*-8*c*, the foldable cup 20 can be converted from the folded configuration, as shown in FIG. 8*a*, to the expanded configuration, as shown in FIG. 8*c*, by applying force in the direction of arrows 78 against the reinforcing strips 42 on the sides of the folded cup. As force is applied, the cup wall 22 begins to flex outwards as shown in FIG. 8*b*. The force is continued until cup wall 22 forms the substantially cylindrical shape of its expanded configuration as shown in FIG. 8*c*. After the full expanded configuration is obtained, the base member (see FIG. 10) is inserted in the bottom opening in order to maintain the foldable cup 20 in the expanded configuration. As shown in FIG. 8*c*, to return the cup to the folded configuration, the user simply removes the top cap and base member from the expanded cup and simply presses in the direction of arrows 76. Force is applied in the direction of arrows 76 until the foldable cup 20 is folded to its substantially flat profile as shown in FIG. 8*a*.

Figure 10:
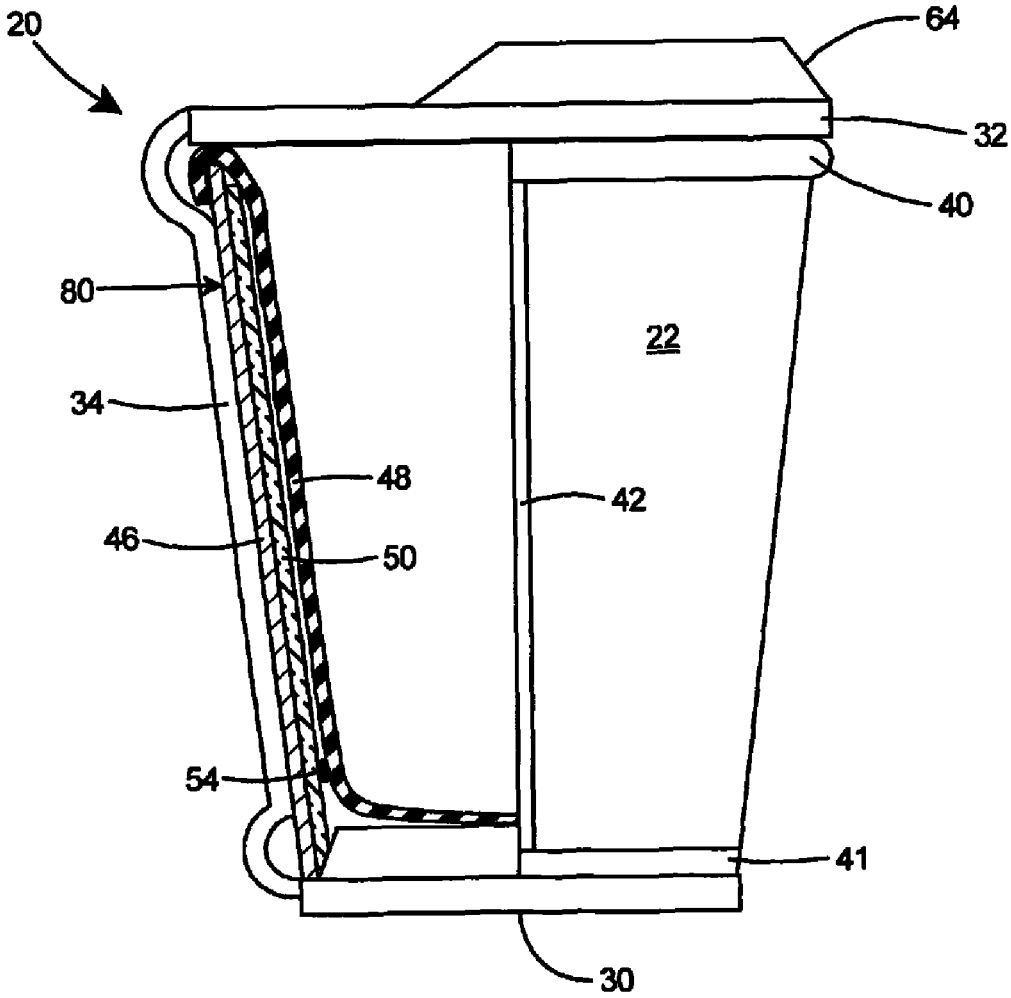
FIG. 10 is a side view of the thermally insulated foldable cup of the present invention in its expanded configuration with a section of the wall cut away to depict the base and cap seated in the cup.

FIG. 10 depicts the foldable cup 20 in its expanded configuration and with the base member 30 and cap member 32 both inserted into the respective open ends of the cup. In the expanded configuration, flexible inner liner 48 holds any liquids within the cup and prevents the liquids from seeping through the cup wall 22. Insulating layer 50 provides thermal insulation, keeping hot drinks hot and cold drinks cold. Outer shell 46 provides the rigidity and toughness to withstand handling but also the flexibility to enable repeated conversions from the expanded configuration to the folded configuration and vice versa. Top reinforcing ring 40, base reinforcing ring 41, and reinforcing strips 42 add further rigidity and support to the cup in the expanded configuration. Base member 30, when inserted in the bottom opening 26, functions to maintain the foldable cup 20 in the expanded configuration regardless of whether the cap member 32 is inserted or not. Thus, cap member 32 can be removed as desired by the user in order to refill the cup.

Figure 9:
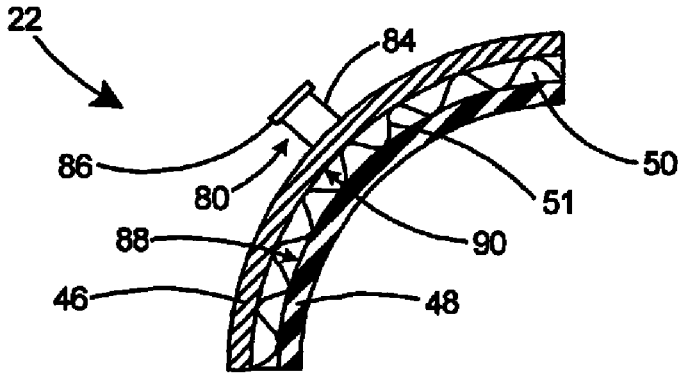
FIG. 9 is a sectional view of a portion of the cup wall depicting the various layers that form the cup wall including an insulating layer constructed of corrugated paper.

With reference to FIG. 9 there is shown an alternative embodiment for the cup wall 22 wherein the insulating layer 50 consists of corrugated paper 51 disposed between the outer shell 46 and the inner liner 48. Use of corrugated paper as the insulating layer 50 provides a substantial amount of dead air space in the space between the outer shell 46 and the inner liner 48 and thus inhibits heat or cold transfer from the interior to the exterior of the cup. FIG. 9 also depicts posts 80, which are integral with the outer surface 82 of outer shell 46. Posts 80 may include a narrow stem 84 and a wider rim 86 to serve as an attachment arrangement for securing the anchor strip 34 of the closing arrangement 28 (see FIG. 10) to the outer shell 46 of the foldable cup 20. The closing arrangement 28, being preferably constructed of flexible plastic material, can be attached to the outer shell 46 by snapping the anchor strip 34 of the closing arrangement 28 over the posts 80. Apertures 52 (see FIG. 3) in closing arrangement 28 are simply aligned with the posts 80 and force applied until rims 86 of posts 80 snap through the apertures 52. In this manner, the anchor strip 34 can be secured to the outer shell 46 of the foldable cup 20.

As shown in FIG. 9, the inner liner 48 of the foldable cup 20 includes an outer surface 88 and the outer shell 46 includes an inner surface 90. The outer surface 88 of the inner liner 48 may be secured to the inner surface 90 of the outer shell 46 by applying one or more spots of adhesive 54 substantially near the bottom rim 38 of the cup.

Preferably, the insulating layer is constructed from fibers, fabric, foam, corrugated paper, or plastic. Fibers can include cotton, wool, or other natural or synthetic fibers. Fabrics and include woven sheets of cotton, felt, or other materials. Foam can include polyurethane foam, STYROFOAM®, or similar foams. The flexible inner liner is preferably constructed of silicone rubber. Silicone rubber has the advantage that it is acceptable for food contact, it is flexible, and it provides thermal insulation properties. As mentioned hereinabove, the closing arrangement 28 including the base member 30, cap member 32, and anchor strip 34, is preferably molded in one piece of plastic. The reinforcing rings 40 and 41 and reinforcing strips 42 are preferably constructed of metal or plastic materials with a good memory, which memory materials have the characteristic of easily changing configuration from one shape to another shape without undergoing permanent deformation or undergoing fatigue from repeated configurations. Such memory materials can be constructed of metal or plastic. Most preferably, the reinforcing rings 40 and 41 of the present invention are constructed of spring metal. The reinforcing rings 40 and 41, being constructed of good memory materials, enable the foldable cup of the present invention to spring from the expanded configuration to the folded configuration and vice versa and enable repeated reconfigurations without any damage or fatigue to the foldable cup.

As the invention has been described, it will be apparent to those skilled in the art that the same may be varied in many ways without departing from the spirit and scope of the invention. Any and all such modifications are intended to be included within the scope of the appended claims.

What is claimed is:

1. A thermally insulated foldable cup capable of being reconfigured between an expanded configuration and a folded configuration comprising:

a cup wall including an outer shell, a flexible inner liner, a top opening, and a bottom opening;

an insulating layer between said outer shell and said inner liner;

a base member capable of insertion at said bottom opening for keeping said cup in said expanded configuration; and two vertical reinforcing strips on opposing sides of said cup, said vertical reinforcing strips defining hinge lines around which two sides of the cup can be folded about a vertical plane through the hinge lines.

2. The foldable cup of claim 1 including a cap member; and an anchor strip connecting said base member to said cap member.

3. The foldable cup of claim 2 wherein said cap member includes a lid portion for engaging said top rim of said foldable cup when said foldable cup is in the expanded configuration; and a top sealing portion extending from said lid portion, said top sealing portion configured to extend within said foldable cup at said top opening.

4. The foldable cup of claim 1 wherein said base member includes a flange portion for engaging said bottom rim of said cup in said expanded configuration; and a bottom sealing portion configured to extend within said foldable cup at said bottom opening.

5. The foldable cup of claim 2 wherein said anchor strip is secured to said outer shell of said foldable cup.

6. The foldable cup of claim 1 wherein the material of construction of said outer shell is selected from the group including metal, plastic, paper, and paper laminated with plastic.

7. The foldable cup of claim 1 wherein the material of construction of said insulating layer is selected from the group including fibers, fabric, foam, corrugated paper, and plastic.

8. The foldable cup of claim 1 wherein the material of construction of said flexible inner liner is silicone rubber.

9. The foldable cup of claim 2 including a locking strap having a first end and second end;

said locking strap secured to said base member at said first end; and said second end of said locking strap including a cap engagement mechanism whereby said locking strap can be engaged with the cap member in order to hold the foldable cup in the folded configuration.

10. The foldable cup of claim 9 wherein said cap engagement mechanism is selected from the group including snaps and hook and loop fasteners.

11. The foldable cup of claim 1 wherein the material of construction of said reinforcing strips is selected from the group including metal and plastic.

12. The foldable cup of claim 5 wherein the anchor strip is secured to the outer shell of the foldable cup with adhesive.

* * * * *